US009706831B2

(12) United States Patent
Wu et al.

(10) Patent No.: US 9,706,831 B2
(45) Date of Patent: Jul. 18, 2017

(54) PORTABLE SILICA GEL NOCTILUCENT CUP

(71) Applicant: WENZHOU SHENGBO TECHNOLOGY CO., LTD., Wenzhou, Zhejiang (CN)

(72) Inventors: Jianjun Wu, Zhejiang (CN); Zhanfeng Liu, Zhejiang (CN); Gang Zhou, Zhejiang (CN); Guocheng Zhang, Zhejiang (CN)

(73) Assignee: WENZHOU SHENGBO TECHNOLOGY CO., LTD., Wenzhou, Zhejiang (CN)

( * ) Notice: Subject to any disclaimer, the term of this patent is extended or adjusted under 35 U.S.C. 154(b) by 48 days.

(21) Appl. No.: 14/877,274

(22) Filed: Oct. 7, 2015

(65) Prior Publication Data

US 2016/0257464 A1 Sep. 8, 2016

(30) Foreign Application Priority Data

Mar. 6, 2015 (CN) ..... 2015 2 0129095 U

(51) Int. Cl.
*A47G 19/22* (2006.01)
*A45F 5/10* (2006.01)
*A45F 5/02* (2006.01)

(52) U.S. Cl.
CPC ..... *A45F 5/10* (2013.01); *A45F 5/021* (2013.01); *A45F 2200/0516* (2013.01); *A45F 2200/0583* (2013.01)

(58) Field of Classification Search
CPC ..... A47G 2019/2238; A47G 2200/08; B65D 51/248; A45F 2200/0583; A45F 5/10; A45F 5/021
USPC ..... 362/101
See application file for complete search history.

(56) References Cited

U.S. PATENT DOCUMENTS 5,178,450 A * 1/1993 Zelensky ..... A47G 19/30 362/101
5,235,930 A * 8/1993 Pendleton ..... B63B 3/08 114/312
6,179,436 B1 * 1/2001 Gitkind ..... B65D 51/24 362/101

(Continued)

FOREIGN PATENT DOCUMENTS

CN 101273953 A * 10/2008

*Primary Examiner* — Scott McNurlen
(74) *Attorney, Agent, or Firm* — Christensen, Fonder, Dardi & Herbert PLLC

(57) ABSTRACT

A portable silica gel noctilucent cup, which can be used as lighting equipment, is energy-saving and environment-friendly, and convenient to carry, overcoming defects in the prior art. The cup comprises: a cup body made of transparent or semitransparent silica gel, an opening portion of which is fixedly provided with a first fixed ring for supporting itself; a cup cover covered on the cup body, at least one face of the cup body towards the opening portion being transparent; and a light-emitting assembly comprising a light source, a solar battery panel mounted to a top portion of the cup cover, and a storage battery, which are electrically connected to the light source; wherein, a holding cavity for holding the battery and the light source is arranged on the cup cover, and at least a wall face of the holding cavity towards the opening portion transmits light.

25 Claims, 13 Drawing Sheets

(56) References Cited

U.S. PATENT DOCUMENTS

| | | | | |
|---|---|---|---|---|
| 7,311,526 | B2 * | 12/2007 | Rohrbach | H01R 13/6205 439/218 |
| 7,975,887 | B1 * | 7/2011 | Esposito | A45F 5/10 224/148.6 |
| 9,322,520 | B1 * | 4/2016 | Li | G02B 6/0011 |
| 9,353,920 | B2 * | 5/2016 | Callanan | F21L 4/08 |
| 2009/0175029 | A1 * | 7/2009 | Chiang | B65D 51/248 362/101 |
| 2010/0214774 | A1 * | 8/2010 | Liu | F21S 9/037 362/183 |
| 2012/0134143 | A1 * | 5/2012 | Lederer | B65D 51/248 362/183 |
| 2013/0153591 | A1 * | 6/2013 | Grimes | A01K 91/02 220/735 |
| 2014/0098525 | A1 * | 4/2014 | Bennett | H02J 7/0052 362/183 |
| 2014/0204565 | A1 * | 7/2014 | Zwierstra | A45C 15/06 362/101 |

* cited by examiner

PORTABLE SILICA GEL NOCTILUCENT CUP

RELATED APPLICATION

The present application claims priority to Chinese Patent Application No. 201520129095.7, filed Mar. 6, 2015, the disclosure of which is hereby incorporated by reference herein in its entirety.

FIELD OF THE INVENTION

The disclosure relates to a cup, and particularly to a portable silica gel noctilucent cup.

BACKGROUND

With the improvement of living standards of people, it becomes an important leisure way for most of people to go out to travel. When going out to travel, travelers often need to carry a large number of articles, such as a portable lamp, a water cup and the like. However, the articles are more, they are more inconvenient to carry, and difficulty is caused.

SUMMARY

To overcome the defect in the background, the disclosure provides a portable silica gel noctilucent cup, which can be used as lighting equipment, is energy-saving and environment-friendly, and is convenient to carry.

The technical solutions adopted by the disclosure are as follows.

Provided is a portable silica gel noctilucent cup, including: a cup body, which is made of silica gel and has certain transparency, wherein, an opening portion of the cup body is fixedly provided with a first fixed ring for supporting the opening portion; a cup cover, which is configured to be covered and fixed on the cup body detachably; and a light-emitting assembly, which includes a solar battery panel, a storage battery, and a light source, wherein, the solar battery panel and the storage battery are electrically connected to the light source; wherein, a holding cavity for holding the storage battery and the light source of the light-emitting assembly is arranged on the cup cover, and at least a wall face of the holding cavity towards the opening portion of the cup body is able to transmit light; and wherein, the solar battery panel is mounted to a top portion of the cup cover.

Provided is a storage method of a portable silica gel noctilucent cup, including steps of: extruding the cup body upwards from the bottom portion; and then bundling the cup body by allowing the hand-carrying belt to bypass the bottom portion of the cup body and buckling the hanging hook to the buckling hook.

The beneficial effects of the disclosure lie in, by adopting the above solutions, that: the cup body is made of silica gel, and can be folded and is convenient to carry; and the opening portion of the cup body is fixed by both of an inner fixed ring and an outer fixed ring and is provided with the cup cover having the solar light-emitting assembly, and can be used as a lighting tool and is energy-saving and environment-friendly. The cup of the disclosure can not only be used as a water cup but also be used for containing and carrying small articles such as a mobile phone and the like, and also can be used as a lamp to light. Therefore, the disclosure has the advantages of being multifunctional and multipurpose.

Figure 1:
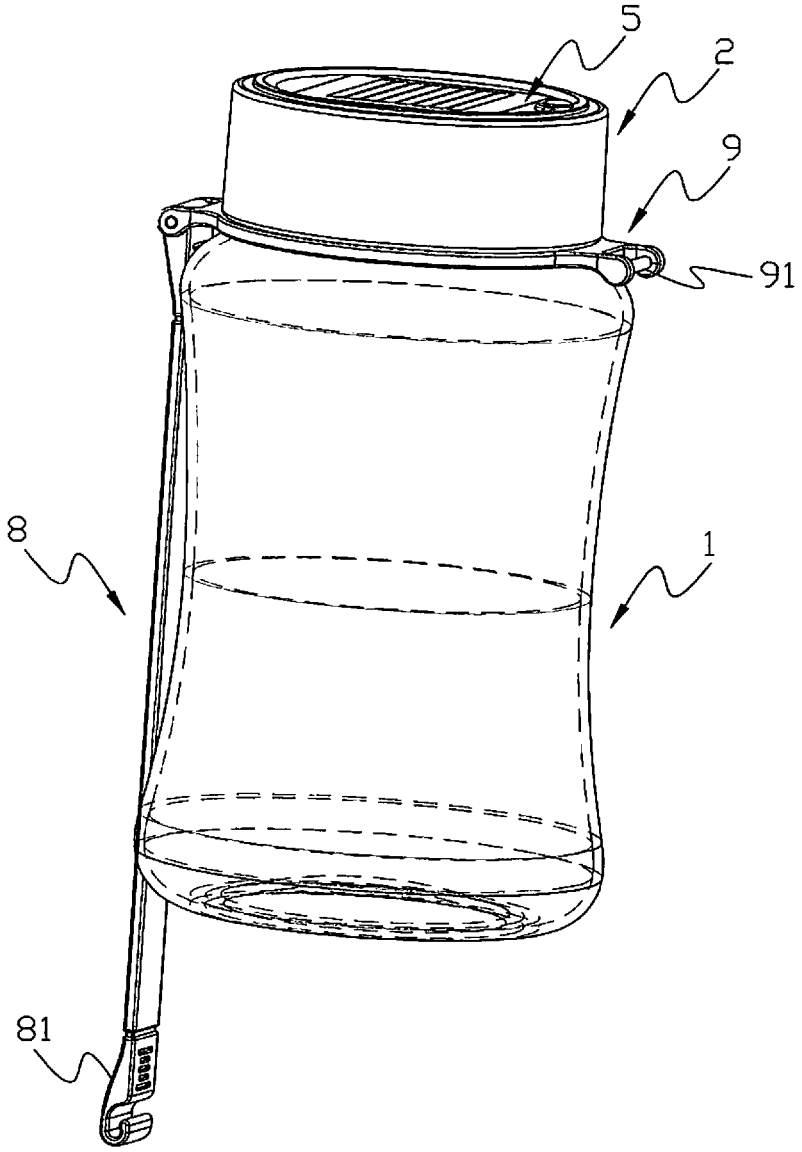
FIG. 1 is a structural schematic diagram of a first embodiment according to the disclosure.

In the figures, a cup body is denoted by 1, a cup cover is denoted by 2, a first fixed ring is denoted by 3, a second fixed ring is denoted by 4, a solar battery panel is denoted by 5, a light source is denoted by 6, a storage battery is denoted by 7, a hand-carrying belt is denoted by 8, a lantern ring is denoted by 9, an opening portion is denoted by 11, an inner cover is denoted by 21, an outer cover is denoted by 22, a sealing piece 23 is denoted by 23, a holding cavity is denoted by 24, a connection terminal is denoted by 25, a circumferential wall is denoted by 26, an upper cover is denoted by 27, an intermediate end wall is denoted by 28, a hanging hook is denoted by 81, a buckling hook is denoted by 91, a first clamping portion is denoted by 211, a circumferential wall of the inner cover is denoted by 212, an end wall of the inner cover is denoted by 213, a circular-arc concave groove of the inner cover is denoted by 214, a reinforcing convex rib is denoted by 215, a concave cavity is denoted by 216, a second clamping portion is denoted by 221, a circumferential wall of the outer cover is denoted by 222, an upper end wall of the outer cover is denoted by 223, a circular-arc boss of the outer cover is denoted by 224, a notch is denoted by 231, a clamping boss is denoted by 251, a terminal via-hole is denoted by 261, a waterproof plug is denoted by 262, an O-shaped ring mounting groove is denoted by 271, an upper cavity chamber is denoted by 281, a lower cavity chamber is denoted by 282, a clamping bulge is denoted by 2111, an inclined face is denoted by 2112, an upper circumferential wall is denoted by 2121, an intermediate circumferential wall is denoted by 2122, a lower circumferential wall is denoted by 2123, a clamping groove is denoted by 2211, and a via-hole is denoted by 2231.

DETAILED DESCRIPTION

Embodiments according to the disclosure are further explained below in conjunction with the drawings.

First Embodiment

As shown in FIGS. 1 to 6, a portable silica gel noctilucent cup is provided in the first embodiment, and the portable silica gel noctilucent cup includes: a cup body 1, which is made of silica gel and has certain transparency, which means that the cup body is not non-light-transmitting but enables light rays to transmit outwards from an inside of the cup body; a cup cover 2, which is configured to be screwed on the cup body 1; and a light-emitting assembly, which includes a solar battery panel 5, a storage battery 7, and a light source 6, wherein, the solar battery panel 5, the storage battery 7, and the light source 6 are electrically connected thereamong; wherein, a holding cavity 24 for holding the storage battery 7 and the light source 6 of the light-emitting assembly is arranged on the cup cover 2, and a wall face of the holding cavity 24 towards the opening portion 11 of the cup body 1 is able to transmit light; wherein, the solar battery panel 5 is mounted to a top portion of the cup cover 2; and wherein, the light source 6 may be an LED lamp and located at an intermediate position of the holding cavity 24. The first embodiment not only has a function of an ordinary cup but also can be used as a lighting tool, and also is energy-saving and environment-friendly due to usage of the solar light-emitting assembly.

Figure 2:
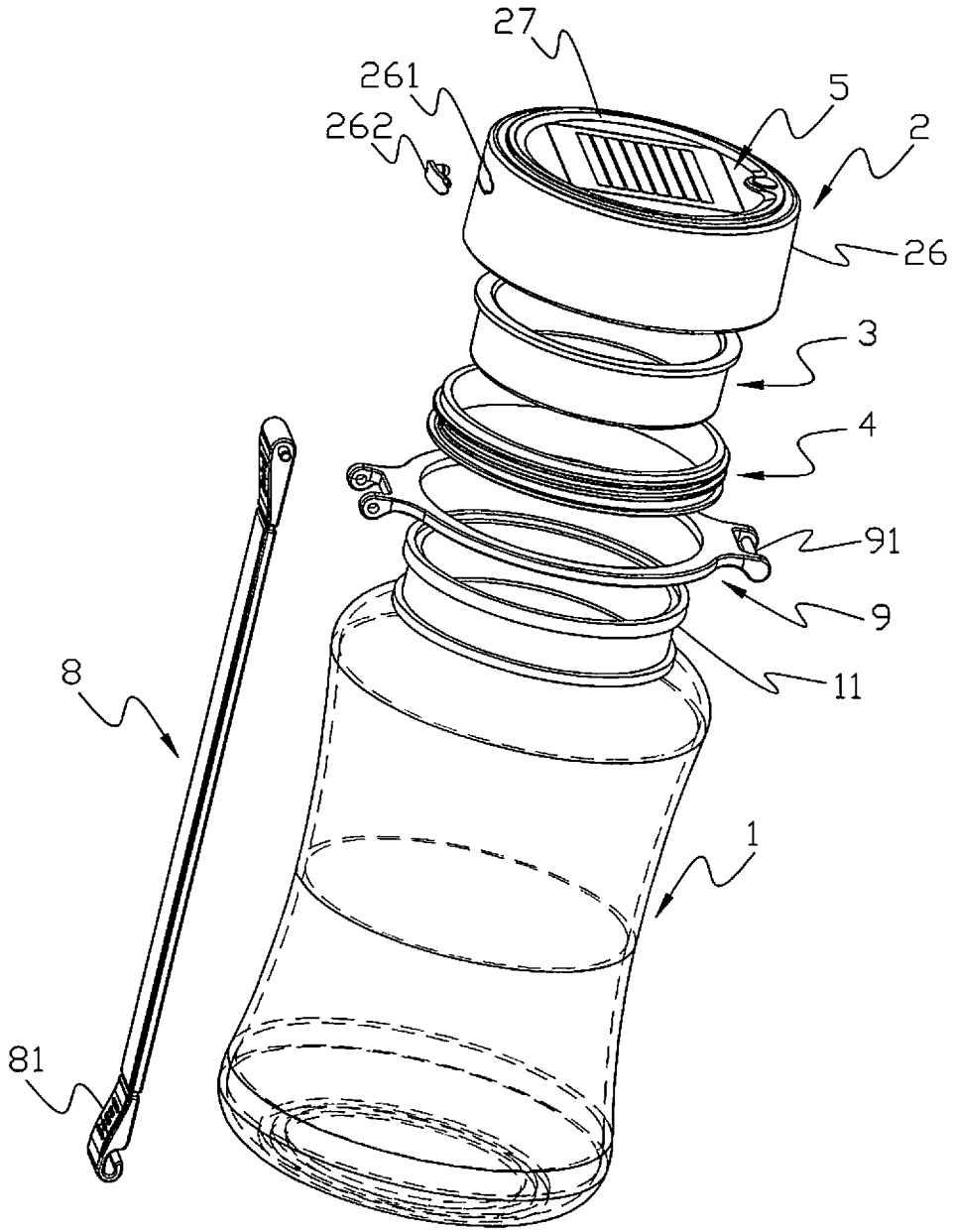
FIG. 2 is an exploded view of the first embodiment according to the disclosure.
Figure 3:
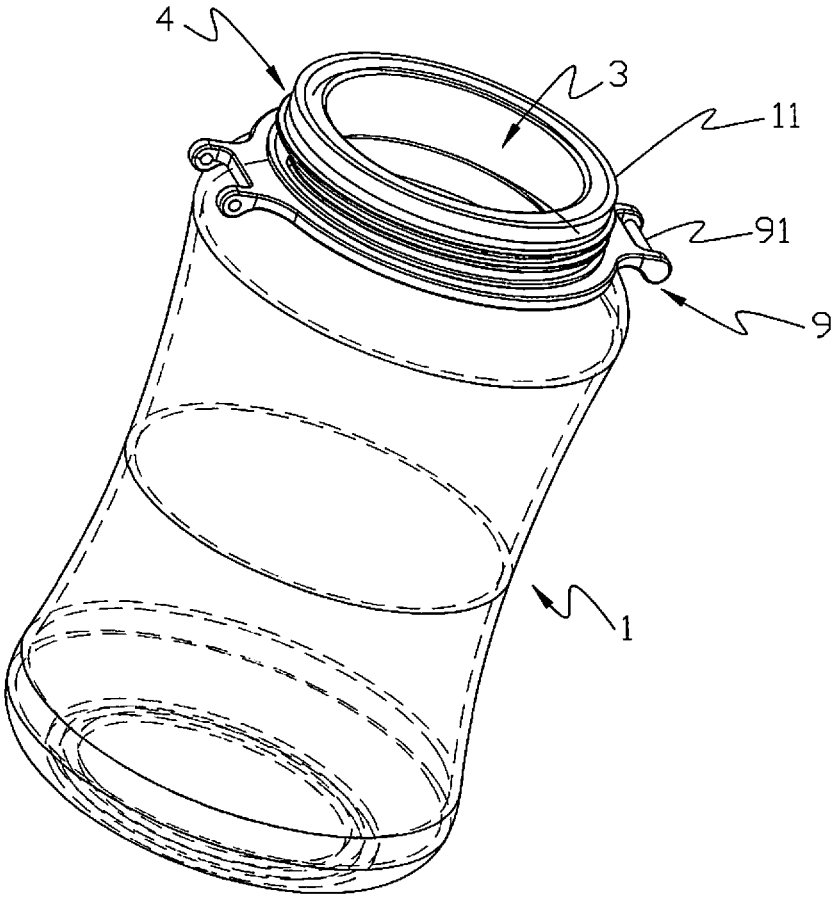
FIG. 3 is a schematic diagram of a cup body of the first embodiment according to the disclosure.
Figure 4:
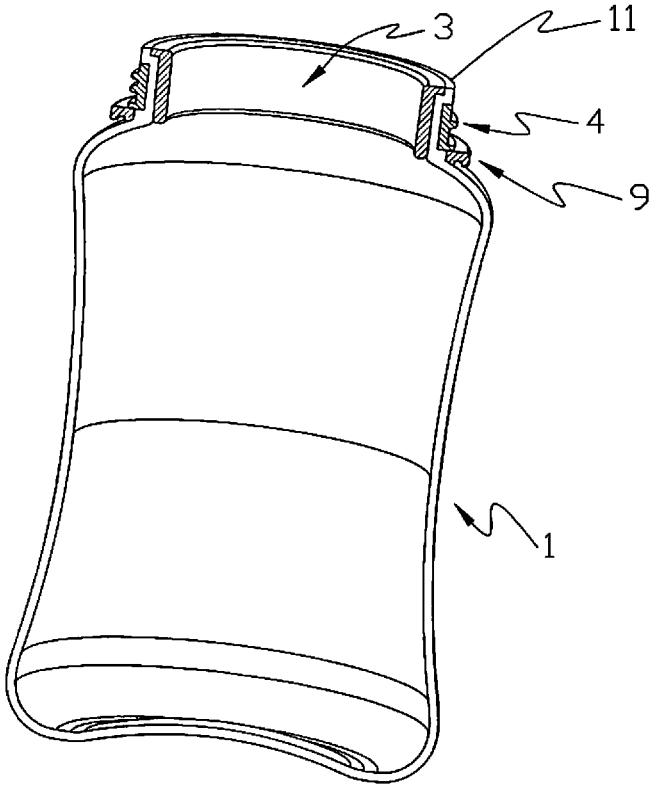
FIG. 4 is a cutaway view of the cup body of the first embodiment according to the disclosure.

As shown in FIGS. 2, 3 and 4, a fixed structure for the cup body 1 of the portable silica gel noctilucent cup is provided in the first embodiment, and specifically, an opening portion 11 of the cup body 1 is fixedly provided with a first fixed ring 3 for supporting the opening portion and is provided with a second fixed ring 4 corresponding to the first fixed ring 3, and the first fixed ring 3 and the second fixed ring 4 are arranged inside and outside the opening portion 11 respectively. According to the structure of the first embodiment, the opening portion of the cup body 1 is supported open and fixed by the first fixed ring 3 and the second fixed ring 4. The first fixed ring 3 and the second fixed ring 4 are generally made of plastic and have certain hardness. Since the first fixed ring 3 and the second fixed ring 4 can support fixedly the silica gel cup body and keep the opening portion avoiding deformation due to flexibility of the silica gel material thereof, and also a threaded structure is arranged outside the second fixed ring 4 and can be spirally matched with the cup cover 2, good sealing performance is ensured. In the embodiment, it is also possible to arrange only the first fixed ring, and the fixing is implemented in a way where the whole cup body is formed by integral injection molding.

As shown in FIGS. 1, 2 and 3, a structure of a hand-carrying belt 8 of the portable silica gel noctilucent cup is provided in the first embodiment, and specifically includes: a lantern ring 9, which is sleeved at the opening portion 11 of the cup body 1 and located below the second fixed ring 4, wherein, an inner diameter of the lantern ring 9 is less than an outer diameter of the second fixed ring 4, thus enabling to prevent the lantern ring from dropping out of the cup body; a hand-carrying belt 8, which is arranged at one side of the lantern ring 9, wherein, a hanging hook 81 is arranged on the hand-carrying belt 8; and a buckling hook 91, which is arranged at the other side of the lantern ring 9 to be matched with the hanging hook 81 in a buckling way. In this embodiment, the hand-carrying belt does not pass through the lantern ring either, namely, is directly arranged at one end of the opening portion of the cup body, and the buckling hook 91 is directly arranged at the other end of the opening portion of the cup body.

As shown in FIG. 2, the buckling hook 91 is a structure where two pile heads are equipped with one pin shaft, and the hanging hook 81 is a flat structure fitting with the pin shaft. It is possible to expect that the buckling hook may also be other shapes, such as a ring.

As shown in FIG. 2, a length of the hand-carrying belt 8 added with a length of the buckling hook 91 is far less than a length from a root portion of the hand-carrying belt 8, through one side wall, a bottom portion, and the other side wall of the cup body 1, to the buckling hook 91. Such is beneficial to store and bundle the silica gel cup body, thus reducing occupied space when carried. The particular steps are as follows: the cup body 1 is extruded upwards from the bottom portion; and then the cup body 1 is bundled by allowing the hand-carrying belt 8 to bypass the bottom portion of the cup body 1 and buckling the hanging hook 81 to the buckling hook 91.

Figure 5:
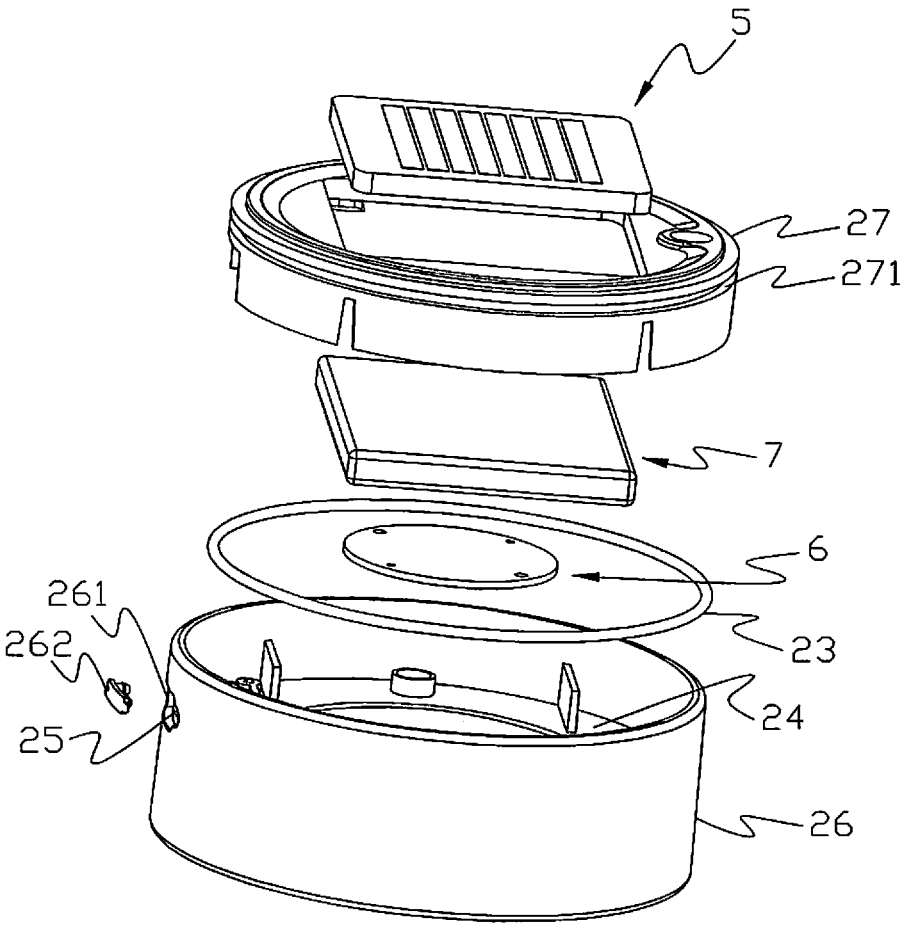
FIG. 5 is an exploded view of a cup cover of the first embodiment according to the disclosure.
Figure 6:
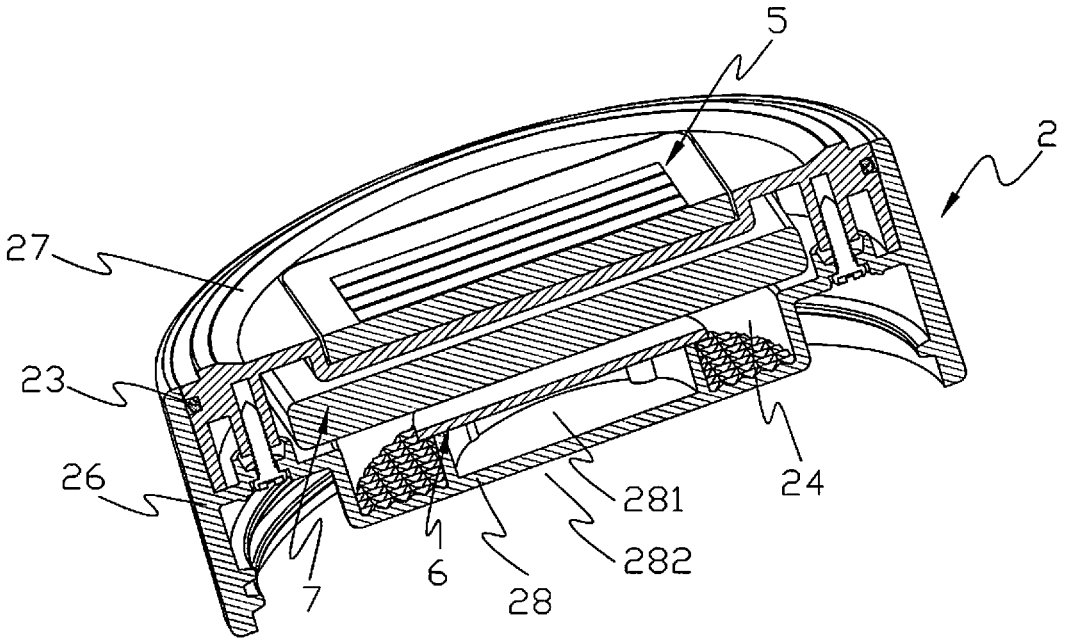
FIG. 6 is a cutaway view of the cup body of the first embodiment according to the disclosure.
Figure 7:
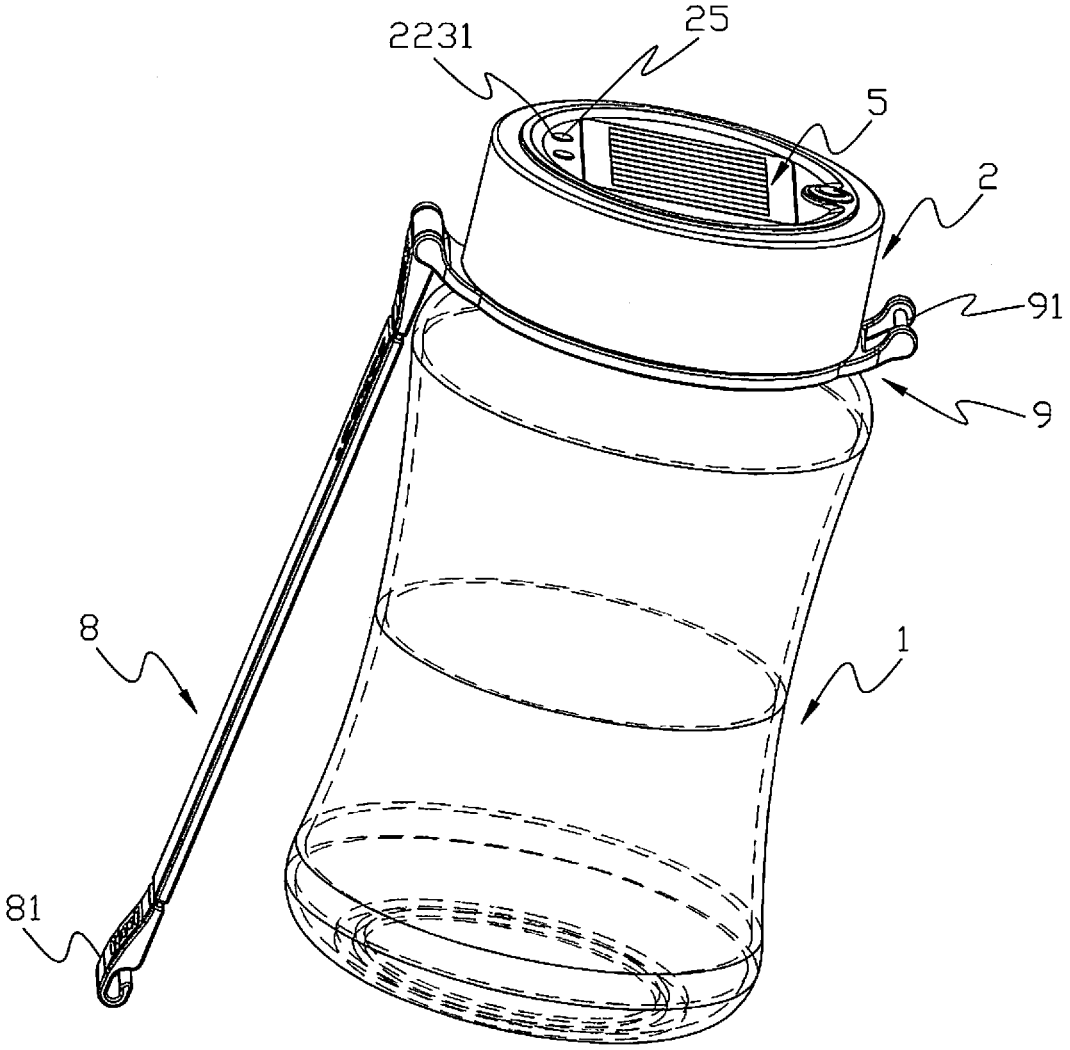
FIG. 7 is a structural schematic diagram of a second embodiment according to the disclosure.
Figure 8:
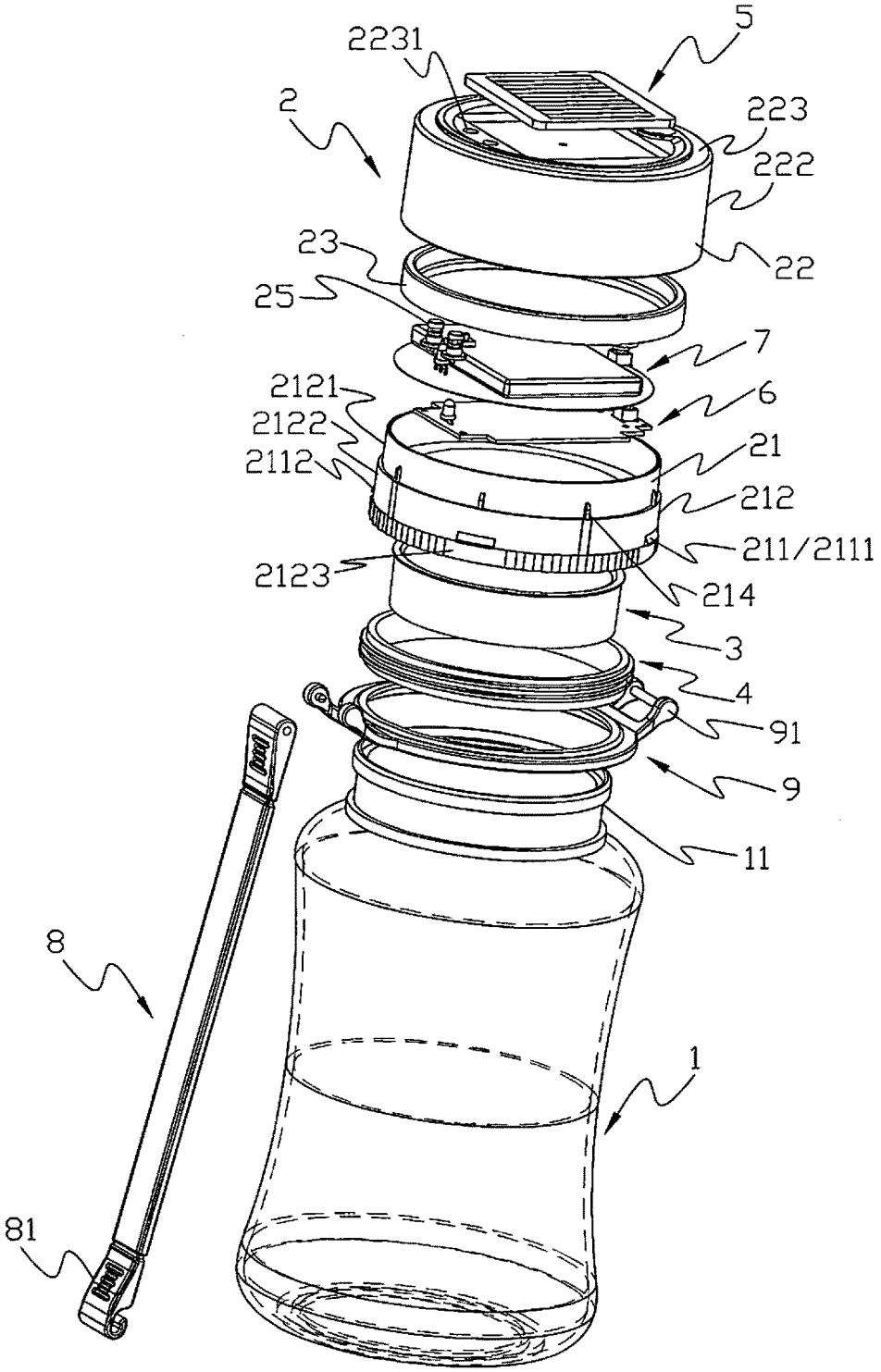
FIG. 8 is an exploded view of the second embodiment according to the disclosure.
Figure 9:
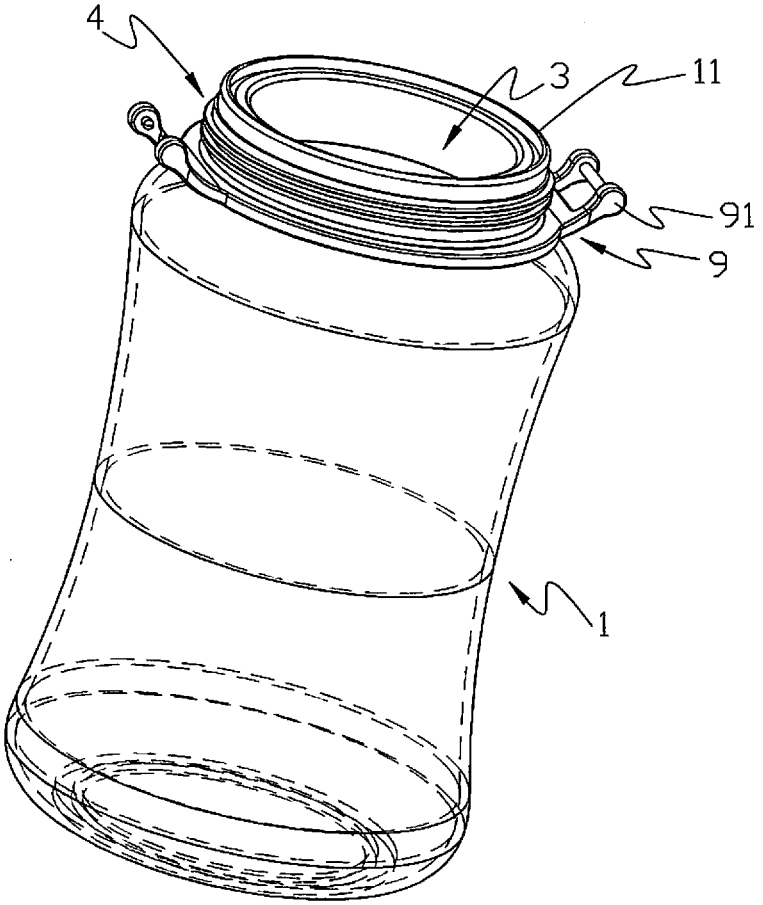
FIG. 9 is a schematic diagram of a cup body of the second embodiment according to the disclosure.
Figure 10:
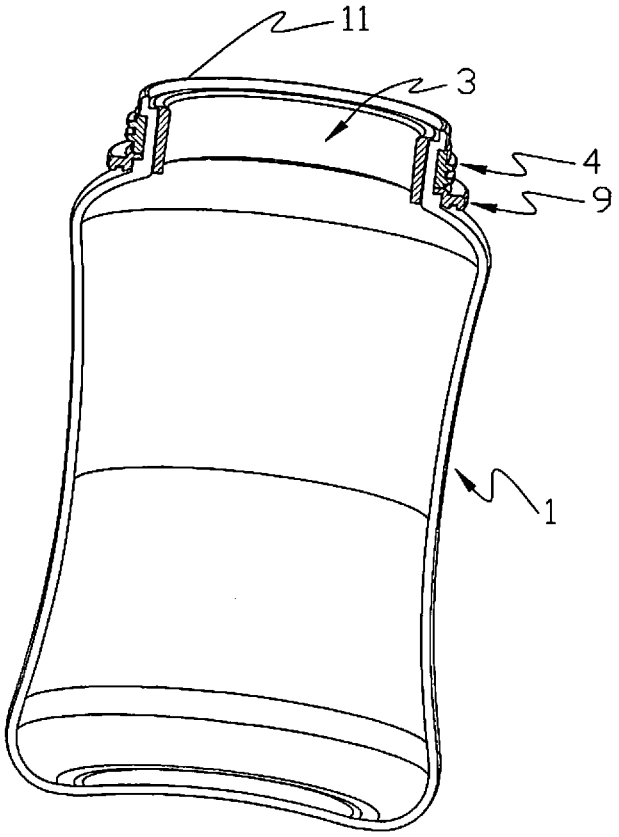
FIG. 10 is a cutaway view of the cup body of the second embodiment according to the disclosure.

As shown in FIGS. 5 and 6, a structure of a cup cover 2 of the portable silica gel noctilucent cup is provided in the first embodiment, and specifically includes: a circumferential wall 26, a lower side of which is configured to be connected with the opening portion 11 of the cup body 1; an intermediate end wall 28, which is substantially located at an intermediate position of the circumferential wall 26, and divides the circumferential wall 26 into an upper cavity chamber 281 and a lower cavity chamber 282; and an upper cover 27, which is sealed by a sealing piece 23 and covered at an upper end of the upper cavity chamber 281, and forms, with the upper cavity chamber 281, the holding cavity 24 for holding the storage battery 7 and the light source 6 of the light-emitting assembly. In the figures, the sealing piece 23 is an O-shaped ring, an edge of the upper cover 27 is provided with an O-shaped ring mounting groove 271, and the upper cover 27 is matched with the sealing piece 23 and mounted into the circumferential wall 26, and then fixed on the intermediate end wall 28 by a screw. The circumferential wall 26, the upper cover 27, the intermediate end wall 28, and the sealing piece 23 together form the holding cavity 24 after mounting of them is finished. Such structure ensures sealability of the holding cavity 24.

As shown in FIG. 5, a connection terminal 25 for externally connecting a power source is further arranged on the circumferential wall 26 at a position corresponding to the upper cavity chamber 281, and the connection terminal 25 is electrically connected to the storage battery 7. The connection terminal 25 is in a form of a USB interface, a terminal via-hole 261 suitable for the USB interface is formed on the circumferential wall 26, and the circumferential wall 26 is equipped with a waterproof plug 262 fitting with the terminal via-hole 261. According to the structure of the first embodiment, the USB interface is convenient to charge, can be charged not only in a traditional way but also with a charge pal, and is suitable for a power shortage situation which may occur on the solar battery panel 5 on rainy days, outdoors and the like, and moreover, the waterproof plug 262 can ensure that no water enters the holding cavity 24.

As shown in FIG. 6, a lower side of the circumferential wall 26 is provided with an inner thread, which is configured to be matched with an outer thread of the second fixed ring 4. The threaded structures per se have sealing functions. The structure of the first embodiment ensures that: the cup body 1 is convenient to open from the cup cover 2, and the cup body 1 is sealed with the cup cover 2 and is watertight.

As shown in FIG. 6, the intermediate end wall 28 is a light-transmitting material, and ensures that: the light source 6 in the holding cavity 24 can be transmitted through the intermediate end wall 28 and the cup body 1 and enter the outside world, and has lighting effect. The intermediate end wall 28 may selectively use materials with different colors, and also allows the light rays emitted into the outside world to become the colors that a user likes, which is more attractive and more fashionable.

Second Embodiment

Figure 11:
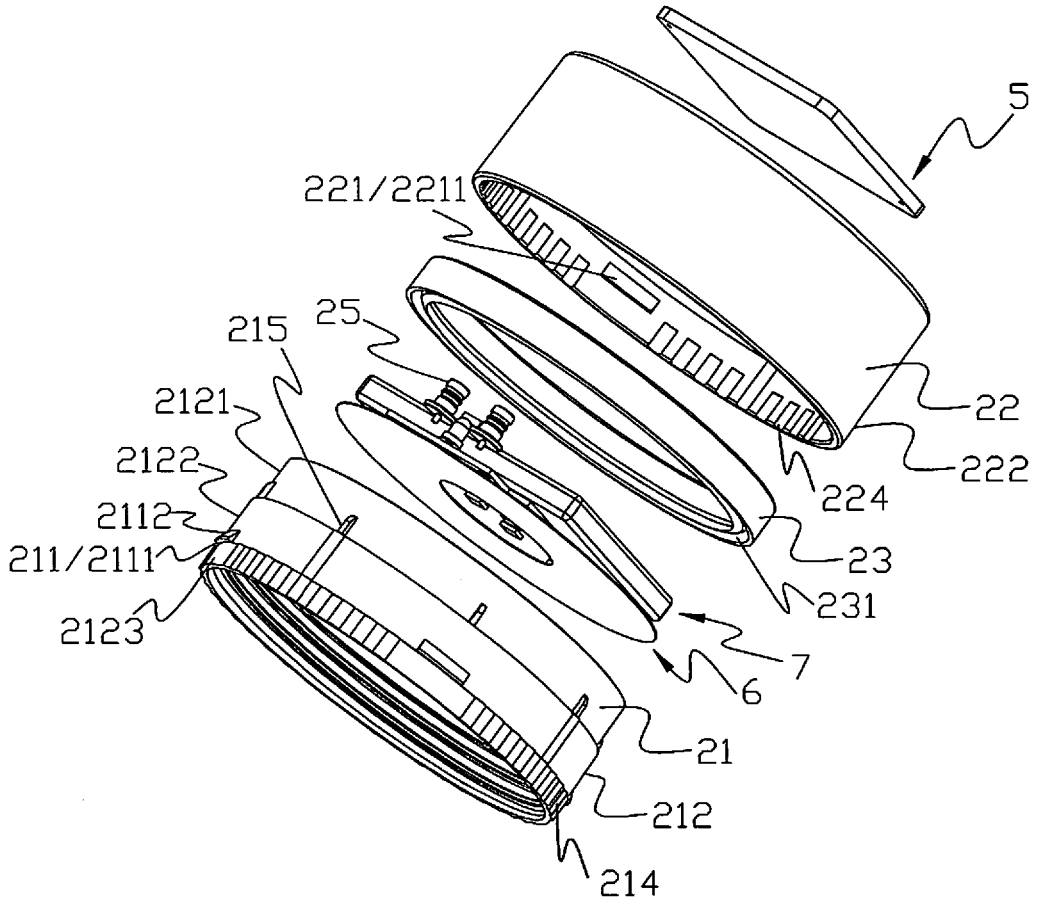
FIG. 11 is an exploded view of a cup cover of the second embodiment according to the disclosure.
Figure 12:
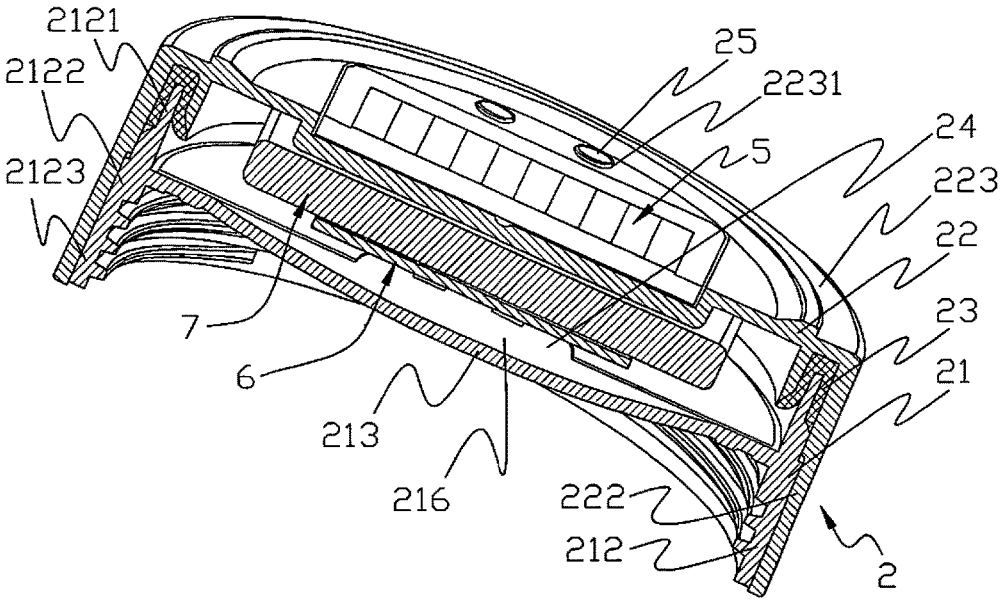
FIG. 12 is a cutaway view of the cup body of the second embodiment according to the disclosure.

As shown in FIGS. 11 and 12, a main difference of this embodiment from the first embodiment lies in a structure of a cup cover, the cup cover includes: an inner cover 21, which has a circumferential wall 212 and an end wall 213, wherein, an outer periphery of the circumferential wall 212 is provided with a first clamping portion 211; an outer cover 22, which has a circumferential wall 222 and an upper end wall 223, wherein, an inner side of the circumferential wall 222 is provided with a second clamping portion 221, which is configured to be matched with the first clamping portion 211 at a clamping position, thus limiting axial separating of the inner cover 21 from the outer cover 22, and wherein, the outer cover 22 is sleeved outside the inner cover 21, is matched with the inner cover 21 at a clamping position through the first clamping portion 211 and the second clamping portion 221, and forms, with the inner cover 21, the holding cavity 24 for mounting the storage battery and the light source; and a sealing piece 23, which is arranged between the inner cover 21 and the outer cover 24 to seal the holding cavity 24.

As shown in FIG. 12, the end wall 213 of the inner cover 21 is substantially located at an intermediate position of the circumferential wall 212, and an upper end face of the end wall 213 forms, with the circumferential wall 212, a concave cavity 216 which forms the holding cavity 24 with a lower end face of the upper end wall 223 of the outer cover 22; and the sealing piece 23 is arranged between an upper end face of the circumferential wall 212 of the inner cover 21 and a lower end face of the upper end wall 223 of the outer cover 22.

As shown in FIG. 12, the upper end wall 213 is a light-transmitting material, and ensures that: the light source 6 in the holding cavity 24 can be transmitted through the upper end wall 213 and the cup body 1 and enter the outside world, and has lighting effect. The upper end wall 213 may selectively use materials with different colors, and also allows the light rays emitted into the outside world to become the colors that a user likes, which is more attractive and more fashionable.

As shown in FIG. 11, the first clamping portion 211 is a clamping bulge 2111 which is convex radially along the outer periphery of the circumferential wall 212 of the inner cover 21, and the second clamping portion 221 is a clamping groove 2211 which is concave radially along the inner side of the circumferential wall 222 of the outer cover 22; an upper end face of the clamping bulge is a inclined face 2112; and a plurality of the clamping bulges 2111 are distributed evenly and circumferentially along the inner cover, and correspondingly, a plurality of the clamping grooves 2211 are distributed evenly and circumferentially along the outer cover. Compared with the thread connection in the first embodiment, the clamping structure in the second embodiment is more convenient to mount and maintain; the inclined face 2112 allows for more convenient mounting of the inner cover 21 and the outer cover 22; and the matching of multiple groups of the clamping bulges 2111 and the clamping grooves 2211 also allows for firmer mounting of the inner cover 21 and the outer cover 22, and the holding cavity 24 has better sealability.

As shown in FIGS. 11 and 12, the circumferential wall 212 of the inner cover 21 comprises an upper circumferential wall 2121, an intermediate circumferential wall 2122, and a lower circumferential wall 2123, the first clamping portion 211 is located outside the intermediate circumferential wall 2122, a circular-arc concave groove 214 is arranged outside the lower circumferential wall 2123, and correspondingly, a circular-arc boss 224 is arranged inside the circumferential wall 222 of the outer cover 22; and a plurality of the circular-arc concave grooves 214 of the inner cover 21 are distributed circumferentially along the inner cover, and also a plurality of the circular-arc bosses 224, which are correspondingly arranged inside the circumferential wall 222 of the outer cover 22, are distributed circumferentially along the outer cover (it is also possible to arrange the circular-arc bosses on the inner cover and arrange the circular-arc concave grooves on the outer cover). The circular-arc boss 224 or circular-arc concave groove 214 in the second embodiment limits the relative positions where the inner cover 21 and the outer cover 22 rotate circumferentially, and moreover, since the circular-arc boss or concave groove is high in matching precision, the inner cover and the outer cover are enabled to have accurate mounting precision and to be convenient to mount when mounted.

As shown in FIGS. 11 and 12, the sealing piece 23 is a sealing ring having, in a cross section thereof, a downward notch 231, and the sealing piece 23 is sleeved on the upper end face of the circumferential wall 212 of the inner cover 21 through the notch 231. According to the sealing structure in the second embodiment, after the inner cover 21 and the outer cover 22 are mounted, since the sealing piece is on the upper end face of the circumferential wall of the inner cover, an upper side of the sealing piece is directly sealed and contacted with the lower end face of the upper end wall 223 of the outer cover 22. In this way, the sealing is more reliable.

As shown in FIG. 11, a certain distance exists between a lower end face of the sealing piece 23 and an upper end face of the intermediate circumferential wall 2122, and a plurality of reinforcing convex ribs are arranged on a circumferential face of the upper circumferential wall 2121 corresponding to the distance. The reinforcing convex ribs 215 in the second embodiment can not only reinforce the strength of the upper circumferential wall 2121 but also limit the relative positions of the inner cover 21 and the outer cover 22 to the sealing piece 23.

Figure 13:
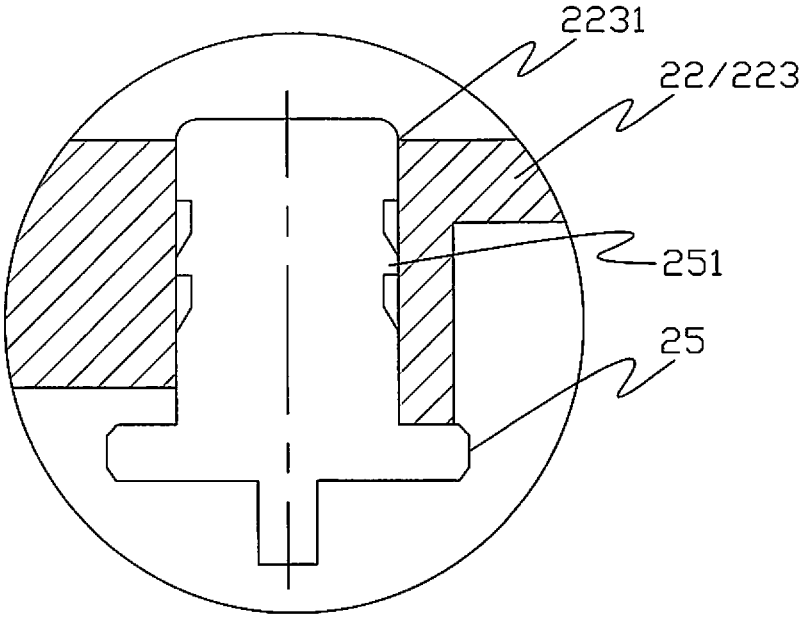
FIG. 13 is a schematic diagram of a connection terminal of the second embodiment according to the disclosure.

As shown in FIG. 13, a structure of a connection terminal of the portable silica gel noctilucent cup is provided in the second embodiment, and specifically, a via-hole 2231 is arranged on the upper end wall 223 of the outer cover 22, a clamping boss 251 is arranged on an radial wall of the connection terminal 25, and the connection terminal 25 is inserted into the via-hole 2231 and matched through the clamping boss 251 at a clamping position. According to the structure in the second embodiment, the connection terminal 25 passes through the via-hole 2231, and the clamping boss 251 can not only ensure reliable and firm connection but also keep good sealability, preventing water from entering the holding cavity 24.

The connection terminal 25 is made of a magnetic conducting material and is matched with a specially-made magnetic charging base for use, and by contacting of both, a charging action can be completed, which is more convenient in operation and also more attractive in appearance compared with the traditional charging way.

The advantages of the disclosure lie in that: the cup body is made of silica gel, and can be folded and is convenient to carry; and the opening portion of the cup body is fixed by both of an inner fixed ring and an outer fixed ring and is provided with the cup cover having the solar light-emitting assembly, and can be used as a lighting tool and is energy-saving and environment-friendly.

Apparently, the above embodiments of the disclosure are examples given only for explaining the disclosure, but non-limitation to embodiments of the disclosure. It is also possible for a person of ordinary skill in the art to make other different forms of changes or variations on a basis of the above explanation. It is unnecessary and either impossible to exhaust all the embodiments. However, these obvious changes or variations belonging to extension of the essential spirit of the disclosure still belong to the protection scope of the disclosure.

The invention claimed is:

1. A portable silica gel noctilucent cup, comprising:

a cup body, which is made of silica gel and has certain transparency, wherein, an opening portion of the cup body is fixedly provided with a first fixed ring for supporting the opening portion;

a cup cover, which is configured to be detachably fixed to the cup body and to cover the opening of the cup body; and a light-emitting assembly, which comprises a solar battery panel, a storage battery, and a light source, wherein, the solar battery panel and the storage battery are electrically connected to the light source;

wherein, a holding cavity for holding the storage battery and the light source of the light-emitting assembly is arranged on the cup cover, and at least a wall face of the holding cavity facing towards the opening portion of the cup body is able to transmit light;

wherein, the solar battery panel is mounted to a top portion of the cup cover; and wherein, the cup cover comprises:

an inner cover, which has a circumferential wall and an end wall, wherein, an outer periphery of the circumferential wall is provided with a first clamping portion;

an outer cover, which has a circumferential wall and an upper end wall, wherein, an inner side of the circumferential wall is provided with a second clamping portion, which is configured to be matched with the first clamping portion at a clamping position, thus limiting axial separating of the inner cover from the outer cover, and wherein, the outer cover is sleeved outside the inner cover, is matched with the inner cover at a clamping position through the first clamping portion and the second clamping portion, and forms, with the inner cover, the holding cavity for mounting the storage battery and the light source; and a sealing piece, which is arranged between the inner cover and the outer cover to seal the holding cavity; and wherein, the end wall of the inner cover is located at an intermediate position of the circumferential wall, and an upper end face of the end wall forms, with the circumferential wall, a concave cavity which forms the holding cavity with a lower end face of the upper end wall of the outer cover.

2. The portable silica gel noctilucent cup according to claim 1, wherein, the opening portion of the cup body is further provided with a second fixed ring, the first fixed ring and the second fixed ring are arranged inside and outside the opening portion, respectively.

3. The portable silica gel noctilucent cup according to claim 1, wherein, the cup cover comprises:

a circumferential wall, a lower side of which is configured to be connected with the opening portion of the cup body;

an intermediate end wall, which is located at an intermediate position of the circumferential wall, and divides the circumferential wall into an upper cavity chamber and a lower cavity chamber; and an upper cover, which is sealed and covered at an upper end of the upper cavity chamber, and forms, with the upper cavity chamber, the holding cavity for holding the storage battery and the light source of the light-emitting assembly.

4. The portable silica gel noctilucent cup according to claim 1, wherein, the sealing piece is arranged between an upper end face of the circumferential wall of the inner cover and a lower end face of the upper end wall of the outer cover.

5. The portable silica gel noctilucent cup according to claim 4, wherein, the sealing piece is a sealing ring having, in a cross section thereof, a downward notch, and the sealing piece is sleeved on the upper end face of the circumferential wall of the inner cover through the notch.

6. The portable silica gel noctilucent cup according to claim 1, wherein, the first clamping portion is a clamping bulge which is convex radially along the outer periphery of the circumferential wall of the inner cover, and the second clamping portion is a clamping groove which is concave radially along the inner side of the circumferential wall of the outer cover.

7. The portable silica gel noctilucent cup according to claim 6, wherein, an upper end face of the clamping bulge is a inclined face.

8. The portable silica gel noctilucent cup according to claim 6, wherein, a plurality of the clamping bulges are distributed evenly and circumferentially along the inner cover, and correspondingly, a plurality of the clamping grooves are distributed evenly and circumferentially along the outer cover.

9. The portable silica gel noctilucent cup according to claim 1, wherein, the circumferential wall of the inner cover comprises an upper circumferential wall, an intermediate circumferential wall, and a lower circumferential wall, the first clamping portion is located outside the intermediate circumferential wall, a circular-arc boss or a circular-arc concave groove is arranged outside the lower circumferential wall, and correspondingly, a circular-arc concave groove or a circular-arc boss is arranged inside the circumferential wall of the outer cover.

10. The portable silica gel noctilucent cup according to claim 9, wherein, a plurality of the circular-arc bosses or the circular-arc concave grooves of the inner cover are distributed circumferentially along the inner cover, and also a plurality of the circular-arc concave grooves or the circular-arc bosses, which are correspondingly arranged inside the circumferential wall of the outer cover, are distributed circumferentially along the outer cover.

11. The portable silica gel noctilucent cup according to claim 9, wherein, an outer diameter of the upper circumferential wall is less than that of the intermediate circumferential wall, and the sealing piece is sleeved on the upper circumferential wall.

12. The portable silica gel noctilucent cup according to claim 11, wherein, the sealing piece is a sealing ring having, in a cross section thereof, a downward notch, and the sealing piece is sleeved on the upper circumferential wall through the notch.

13. The portable silica gel noctilucent cup according to claim 11, wherein, a certain distance exists between a lower end face of the sealing piece and an upper end face of the intermediate circumferential wall, and a plurality of reinforcing convex ribs are arranged on a circumferential face of the upper circumferential wall corresponding to the distance.

14. The portable silica gel noctilucent cup according to claim 1, wherein, a connection terminal for externally connecting a power source is further arranged on the cup cover, and the connection terminal is electrically connected to the storage battery.

15. The portable silica gel noctilucent cup according to claim 3, wherein, a connection terminal for externally connecting a power source is further arranged on the circumferential wall at a position corresponding to the upper cavity chamber, and the connection terminal is electrically connected to the storage battery.

16. The portable silica gel noctilucent cup according to claim 1, wherein, a connection terminal for externally connecting a power source is arranged on the upper end wall of the outer cover, and the connection terminal is electrically connected to the storage battery.

17. The portable silica gel noctilucent cup according to claim 16, wherein, a via-hole is arranged on the upper end wall of the outer cover, a clamping boss is arranged on an radial wall of the connection terminal, and the connection terminal is inserted into the via-hole and matched through the clamping boss at a clamping position.

18. The portable silica gel noctilucent cup according to claim 14, wherein, the connection terminal is made of a magnetic conducting material.

19. The portable silica gel noctilucent cup according to claim 1, further comprising:

a hand-carrying belt, which is arranged at one side of the opening portion of the cup body, wherein, a hanging hook and a buckling hook are arranged on the hand-carrying belt, and the buckling hook is arranged at the other side of the opening portion of the cup body to be matched with the hanging hook in a buckling way.

20. The portable silica gel noctilucent cup according to claim 19, further comprising a lantern ring, which is sleeved at the opening portion of the cup body, wherein, the hand-carrying belt and the buckling hook are both arranged on the lantern ring.

21. The portable silica gel noctilucent cup according to claim 2, further comprising:

a lantern ring, which is sleeved at the opening portion of the cup body and located below the second fixed ring, wherein, an inner diameter of the lantern ring is less than an outer diameter of the second fixed ring;

a hand-carrying belt, which is arranged at one side of the lantern ring, wherein, a hanging hook is arranged on the hand-carrying belt; and a buckling hook, which is arranged at the other side of the lantern ring to be matched with the hanging hook in a buckling way.

22. The portable silica gel noctilucent cup according to claim 19, wherein, a length of the hand-carrying belt added with a length of the buckling hook is less than a length from a root portion of the hand-carrying belt, through one side wall, a bottom portion, and the other side wall of the cup body, to the buckling hook.

23. A storage method of the portable silica gel noctilucent cup according to claim 22, comprising steps of: extruding the cup body upwards from the bottom portion; and then bundling the cup body by allowing the hand-carrying belt to bypass the bottom portion of the cup body and buckling the hanging hook to the buckling hook.

24. A portable silica gel noctilucent cup, comprising:

a cup body, which is made of silica gel and has certain transparency, wherein, an opening portion of the cup body is fixedly provided with a first fixed ring for supporting the opening portion;

a cup cover, which is configured to be detachably fixed to the cup body and to cover the opening of the cup body; and a light-emitting assembly, which comprises a solar battery panel, a storage battery, and a light source, wherein, the solar battery panel and the storage battery are electrically connected to the light source;

wherein, a holding cavity for holding the storage battery and the light source of the light-emitting assembly is arranged on the cup cover, and at least a wall face of the holding cavity facing towards the opening portion of the cup body is able to transmit light;

wherein, the solar battery panel is mounted to a top portion of the cup cover;

wherein, the cup cover comprises:

an inner cover, which has a circumferential wall and an end wall, wherein, an outer periphery of the circumferential wall is provided with a first clamping portion;

an outer cover, which has a circumferential wall and an upper end wall, wherein, an inner side of the circumferential wall is provided with a second clamping portion, which is configured to be matched with the first clamping portion at a clamping position, thus limiting axial separating of the inner cover from the outer cover, and wherein, the outer cover is sleeved outside the inner cover, is matched with the inner cover at a clamping position through the first clamping portion and the second clamping portion, and forms, with the inner cover, the holding cavity for mounting the storage battery and the light source; and a sealing piece, which is arranged between the inner cover and the outer cover to seal the holding cavity; and wherein, the sealing piece is arranged between an upper end face of the circumferential wall of the inner cover and a lower end face of the upper end wall of the outer cover.

25. A portable silica gel noctilucent cup, comprising:

a cup body, which is made of silica gel and has certain transparency, wherein an opening portion of the cup body is fixedly provided with a first fixed ring for supporting the opening portion, and a second fixed ring, the first fixed ring and the second fixed ring are arranged inside and outside the opening portion, respectively;

a cup cover, which is configured to be detachably fixed to the cup body and to cover the opening of the cup body;

a light-emitting assembly, which comprises a solar battery panel, a storage battery, and a light source, wherein, the solar battery panel and the storage battery are electrically connected to the light source, and the solar battery panel is mounted to a top portion of the cup cover;

a lantern ring, which is sleeved at the opening portion of the cup body and located below the second fixed ring, wherein, an inner diameter of the lantern ring is less than an outer diameter of the second fixed ring;

a hand-carrying belt, which is arranged at one side of the lantern ring, wherein a hanging hook is arranged on the hand-carrying belt; and a buckling hook, which is arranged at another side of the lantern ring to be matched with the hanging hook in a buckling way;

wherein, a holding cavity for holding the storage battery and the light source of the light-emitting assembly is arranged on the cup cover, and at least a wall face of the holding cavity facing towards the opening portion of the cup body is able to transmit light.

* * * * *